US006431325B1

(12) United States Patent
Bledsoe et al.

(10) Patent No.: US 6,431,325 B1
(45) Date of Patent: Aug. 13, 2002

(54) ACCELERATION CONTROL SYSTEM UTILIZING ELEVATOR PLATFORM STABILIZATION COUPLER

(75) Inventors: Joseph Bledsoe, Bedford, TX (US); Thomas He, Unionville, CT (US); Richard C. McCarthy, Simsbury, CT (US); Chris Singarella, Ellington, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/976,444

(22) Filed: Oct. 12, 2001

Related U.S. Application Data

(62) Division of application No. 09/535,455, filed on Mar. 24, 2000.

(51) Int. Cl.[7] ..... B66B 1/34
(52) U.S. Cl. ..... 187/292; 318/649
(58) Field of Search ..... 187/292, 334, 187/345; 318/648, 649

(56) References Cited

U.S. PATENT DOCUMENTS

| | | | | | |
|---|---|---|---|---|---|
| 1,918,427 | A | * | 7/1933 | Rice | 187/334 |
| 2,246,732 | A | | 6/1941 | Hymans | 187/1 |
| 4,113,064 | A | * | 9/1978 | Shigeta et al. | 187/251 |
| 4,660,682 | A | * | 4/1987 | Luinstra et al. | |
| 5,020,639 | A | * | 6/1991 | Michel | 187/346 |
| 5,027,925 | A | * | 7/1991 | Kahkipuro | 187/292 |
| 5,814,774 | A | * | 9/1998 | Remmers et al. | 187/292 |
| 5,866,861 | A | * | 2/1999 | Rajamani et al. | 187/292 |
| 5,896,949 | A | * | 4/1999 | Hamdy et al. | 187/292 |
| 6,082,698 | A | | 7/2000 | Dubois | |
| 6,305,502 | B1 | * | 10/2001 | He et al. | 187/292 |
| 6,364,064 | B1 | * | 4/2002 | Rizzi | 187/292 |

* cited by examiner

*Primary Examiner*—Jonathan Salata

(57) ABSTRACT

A platform stabilization coupler for transmitting acceleration forces to an elevator platform disposed on an elevator car frame is presented. The coupler includes a vibration member having a first surface disposed in fixed relation to either one of the elevator car frame and the platform. The coupler additionally includes a linear bearing disposed in fixed relation to a second surface of the vibration member. The bearing is disposed in moveable relation with the other of the elevator car frame and the platform to allow substantially vertically movement of the platform relative to the elevator car frame. The vibration member and linear bearing provide a transmission path for the lateral acceleration forces from the elevator car frame to the platform.

32 Claims, 8 Drawing Sheets

C3>>C1, K3>>K1

$m3 = m1 + m2$

ACCELERATION CONTROL SYSTEM UTILIZING ELEVATOR PLATFORM STABILIZATION COUPLER

This is a division of copending application Ser. No. 09/535,455 filed Mar. 24, 2000, the contents of which is incorporated herein by reference.

TECHNICAL FIELD

The present invention relates to elevator systems and, more particularly, to a platform stabilization coupler to transmit accelerations generated from an elevator system to an elevator platform.

BACKGROUND OF THE INVENTION

To enhance passenger comfort, elevator systems require acceleration control systems to suppress accelerations, e.g., vibrations, transmitted from various components of the elevator system to the elevator car. The elevator car includes an elevator cab mounted on an elevator platform upon which passengers stand. The elevator car also includes an elevator car frame upon which the platform is disposed. Elastomeric isolation pads separate the platform from the frame for sound isolation purposes.

One factor that greatly affects elevator car ride quality is lateral vibration of the elevator car and its associated elevator car platform with respect to the hoistway or elevator guide rails. Lateral vibrations can be caused by aerodynamic forces acting directly on the elevator car during movement. Lateral vibrations may also be attributable to suspension forces resulting from imperfections in the manufacture and installation of the hoistway guide rails, or due to misalignment of the rails caused by the building settlement.

Active-guidance control systems have been employed to reduce or eliminate such lateral vibrations associated with elevator car movement. By way of example, the Active Roller Guide (ARG) control system was designed by Otis Elevator Company as a modernization product that could be deployed across a wide variety of gearless elevator platforms and car frames. The objective of the ARG is to reduce rail and windage induced vibrations to a maximum level of 10 mg at the center of the platform by means of a closed loop, acceleration feedback control. The closed loop design typically includes an acceleration sensor mounted either on the elevator car frame or to the platform, which generates acceleration signals indicative of accelerations at the car frame along a lateral axis. A controller, responding to the acceleration signals, then generates an opposing acceleration force from the rail toward the car frame along the same axis, with an objective of causing a net car frame acceleration of zero.

Referring to FIG. 1, a prior art elevator car two mass block diagram having a typical active guidance system with isolation pads in its feedback path is shown. It can be seen that forces F0 generated from the rail, e.g., from rail misalignment or generated as feedback from a controller, are coupled to the cab/platform mass M1 by two spring/damper pairs: C1, K1 and C2, K2. C2 and K2 are due to the roller guides as the force F0 is transmitted from the guide rails, through the roller guides and to the mass M2 of the elevator car frame. By nature of their design, the damping coefficient C2 and spring constant K2 of the roller guides is substantially constant and known. On the other hand, C1 and K1 are due to the isolation pads between the car frame and the platform, and are not constant or known.

The isolation pads, therefore, are a critical element in the feedback path of the ARG since they provide coupling, i.e., a vibration transmission path, between the car frame and platform. Their primary function is to provide sound isolation from the car frame. Their secondary function is to serve as vertical compression springs in a discrete step load sensor for dispatching and overload sensing purposes. However, the isolation pads where not designed to act as vibration couplers for an acceleration control system. This is because the spring rate K1 and damping coefficient C1 of the isolation pads are inherently variable from elevator system to elevator system due to variations in the manufacturing process. Additionally, the spring rate K1 and damping coefficient C1 do not remain constant over time in that they vary with temperature and aging effects. These variations make the adjustment of the closed loop control difficult to achieve without extensive testing at installation.

The combination of the elevator cab effective mass M1 and the spring rate K1 and damping coefficient C1 of the isolation pads determine a critical resonant mode of the platform termed the plateau resonance. This resonance is in a wide band from approximately 10 to 15 Hz. Because of this resonance condition, large phase and gain displacements are produced, e.g., 50 degrees and 10 dB, which are difficult to suppress by a constant compensation approach. Since the plateau resonance is different between elevator systems, extensive and time consuming in field survey testing is required to properly adjust the control loop gain and phase characteristics for each system.

There is a need therefore, for an improved vibration coupling system between the elevator car frame and the elevator platform.

SUMMARY OF THE INVENTION

This invention offers advantages and alternatives over the prior art by providing a platform stabilization coupler for transmitting accelerations, e.g., vibrations to an elevator platform on an elevator car frame. Advantageously, the coupler bypasses the sound isolation pads in the vibration feedback path of an acceleration control system. The coupler provides predetermined and substantially constant damping coefficients and spring constants between the platform and elevator car frame in lieu of the inherently variable damping coefficient and spring constants of the isolation pads. The coupler also allows the freedom of vertical movement required of the platform relative to the car frame to enable the isolation pads to perform their primary functions of sound isolation and load sensing.

These and other advantages are accomplished in an exemplary embodiment of the invention by providing a platform stabilization coupler for transmitting acceleration forces to an elevator platform disposed on an elevator car frame. The coupler includes a vibration member having a first surface disposed in fixed relation to either one of the elevator car frame and the platform. The coupler additionally includes a linear bearing disposed in fixed relation to a second surface of the vibration member. The bearing is disposed in moveable relation with the other of the elevator car frame and the platform to allow substantially vertical movement of the platform relative to the elevator car frame. The vibration member and linear bearing provide a transmission path for the acceleration forces from the elevator car frame to the platform. The coupler comprises a predetermined and constant spring constant and damping coefficient.

In an alternative exemplary embodiment a plurality of platform stabilization couplers disposed between the platform and the elevator car frame substantially hold the lateral movement of the platform relative to the elevator car frame within predetermined limits. The limits may be adjusted to be very small, i.e., zero lash, so that the platform and car frame move as one mass.

The above discussed and other features and advantages of the present inventions will be appreciated and understood by those skilled in the art from the following detailed descriptions and drawings.

DESCRIPTION OF THE PREFERRED EMBODIMENT

Figure 2:
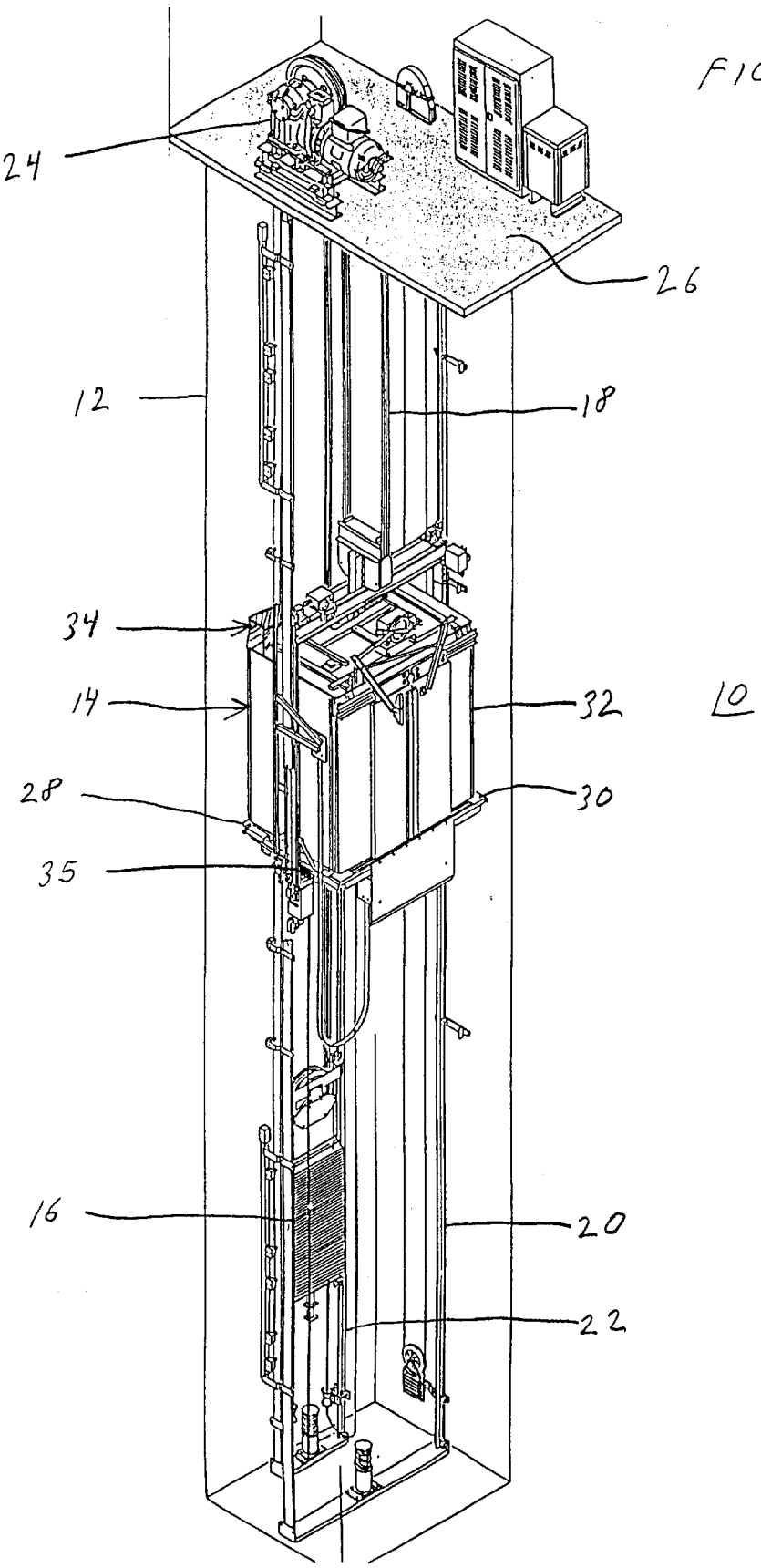
FIG. 2 is a schematic, partial isometric view of an elevator system having platform stabilization couplers in accordance with the present invention.

Referring to FIG. 2, an exemplary embodiment of an elevator system in accordance with the present invention is shown generally at 10. The elevator system comprises an elevator hoistway 12, having an elevator car 14 positioned therein for vertical movement. The elevator car 14 is suspended and coupled to a counterweight 16 for relative movement therewith through a set of elevator ropes 18. Car guide rails 20 and counterweight guide rails 22 provide T-shaped tracks which guide the elevator car 14 and counterweight 16 respectively throughout the hoistway 12. An elevator hoisting machine 24 is located in elevator machine room 26 and provides the mechanical power to hoist the elevator car 14 and passengers.

The elevator car 14 includes an elevator car frame 28, an elevator platform 30, and an elevator cab or cabin 32. The elevator cab 32 typically comprises four vertical walls and a roof and is disposed on the elevator platform 30. The platform 30, together with the elevator cab 32, define an enclosure within which passengers ride. The elevator platform 30 is disposed on the car frame 28, which provides external structural support for the cab 32/platform 30 enclosure of the elevator car 14.

Vibrations felt by the passengers at the platform 30 are reduced or eliminated by guidance control system 34 (best seen in FIG. 3), which includes a set of platform stabilization couplers 35 (best seen in FIG. 4) in its feedback path between the car frame 28 and platform 30. As will be discussed in greater detail hereinafter, the stabilization couplers 35 bypass prior art isolation pads to provide a known, consistent spring constant and damping coefficient for vibration transmission. Moreover, stabilization couplers 35 improve ride quality and system performance over the prior art by holding the lateral movement of the platform 30 relative to the elevator car frame 28 within predetermined limits.

Figure 3:
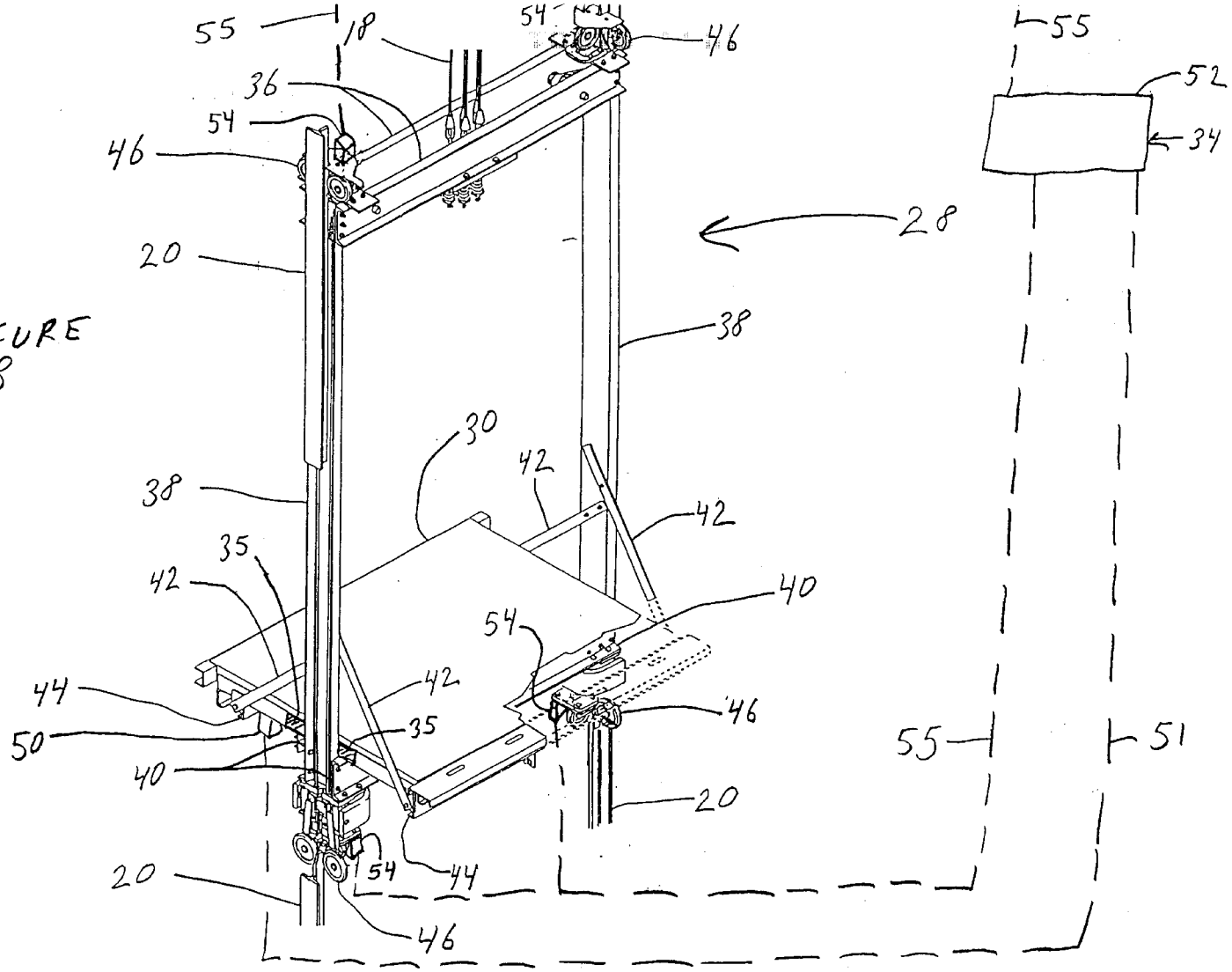
FIG. 3 is a schematic, partial isometric view of the elevator car frame of FIG. 2.

Referring to FIG. 3, the car frame 28 includes a horizontal crosshead 36, a pair of vertically extending stiles 38 joined at the top by the crosshead 36, and one or more safety planks 40 joining the stiles 38 at the bottom. The platform 30 is positioned atop the safety planks 40 and attached to the stiles 38 by connecting brackets 42 connected to support frames 44 on the underside of the platform 30. Active roller guides 46 are located at the four corners of the car frame 28 and engage within the T-shaped tracks of the car guide rails 20. The roller guides 46 provide guidance to the elevator car 14 as it travels within the hoistway 12.

An exemplary embodiment of an elevator control system 34 is comprised of an acceleration sensor 50, controller 52, magnetic actuators 54 and platform stabilization couplers 35. The acceleration sensor 50 is mounted to either of the elevator car frame 28 or the platform 30 and generates acceleration signals indicative of platform 30 lateral accelerations, e.g., vibrations. The controller 52 is typically mounted to the top of the elevator car 14 and receives the acceleration signal through signal lines 51. In response to the acceleration signals, the controller 52 generates an acceleration force against the frame 28 by conducting a predetermined current through current lines 55. The current from controller 52 actuates magnetic actuators 54, mounted to each of the roller guides 46, to magnetically generate the acceleration force against frame 28 in a lateral direction opposed to the platform accelerations. The acceleration force is transmitted from the elevator car frame 28, through the platform stabilization couplers 35 and to the platform 30. The acceleration forces generated by the controller 52 are equal and opposite in direction to the accelerations of the platform 30, causing a net platform acceleration of substantially zero, e.g., 10 mg or less.

Figure 4:
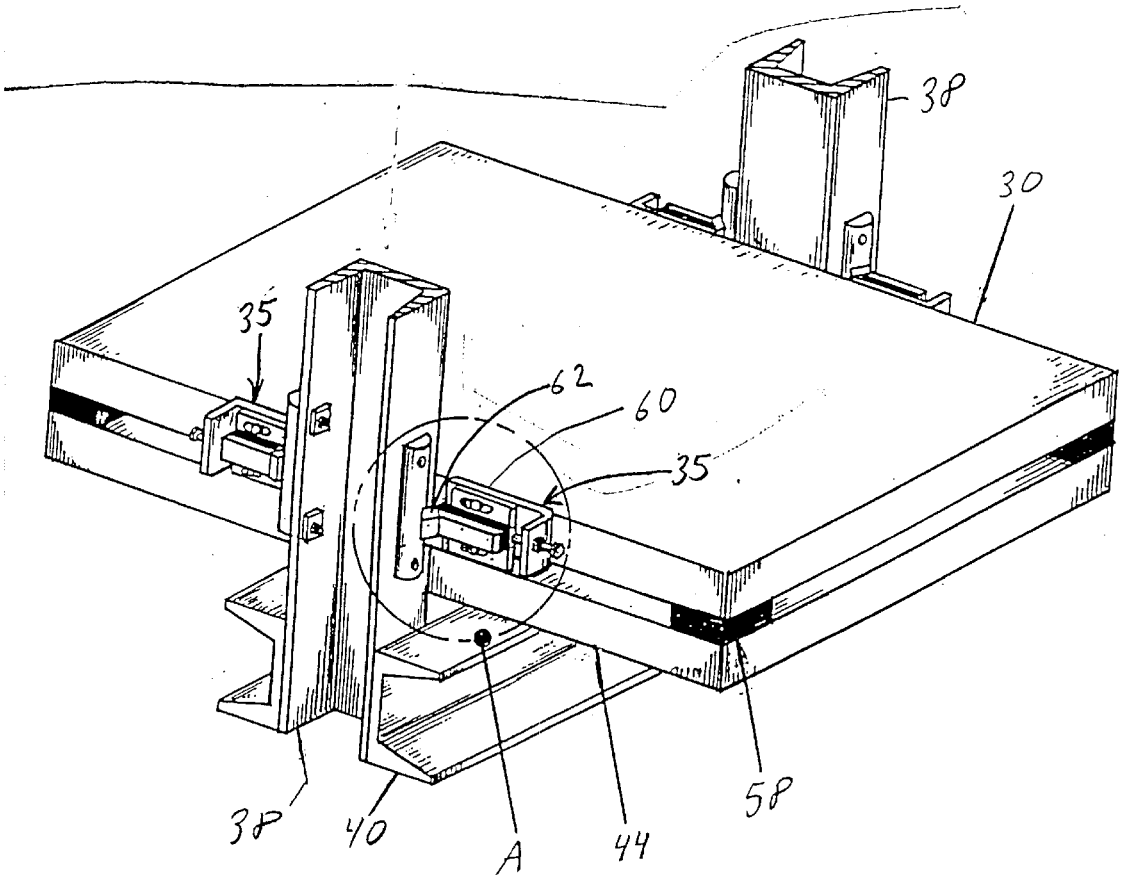
FIG. 4 is a schematic, partial isometric view of the elevator platform of FIG. 3.

Referring to FIG. 4, a set of elastomeric sound isolation pads 58 are positioned between the platform 30 and the support frame 44 of the elevator car frame 28. The primary purposes of the sound isolation pads 58 are to provide sound isolation and to serve as vertical compression springs in a discrete step load sensor for dispatching and overload sensing purposes. In order for the pads 58 to function as springs for load sensing purposes however, vertical freedom of movement of the platform 30 relative to the elevator car frame 28 must be maintained to allow for vertical compression of the pads 58.

Platform stabilization couplers 35 are mounted between the platform 30 and either side of the stiles 38 of the elevator car frame 28. The platform stabilization couplers 35 include a vibration member 60 to transmit vibrations from the elevator car frame 28 to the platform 30, and a linear bearing 62 to allow for vertical freedom of movement of the platform 30 relative to the elevator car frame 28.

Figure 5:
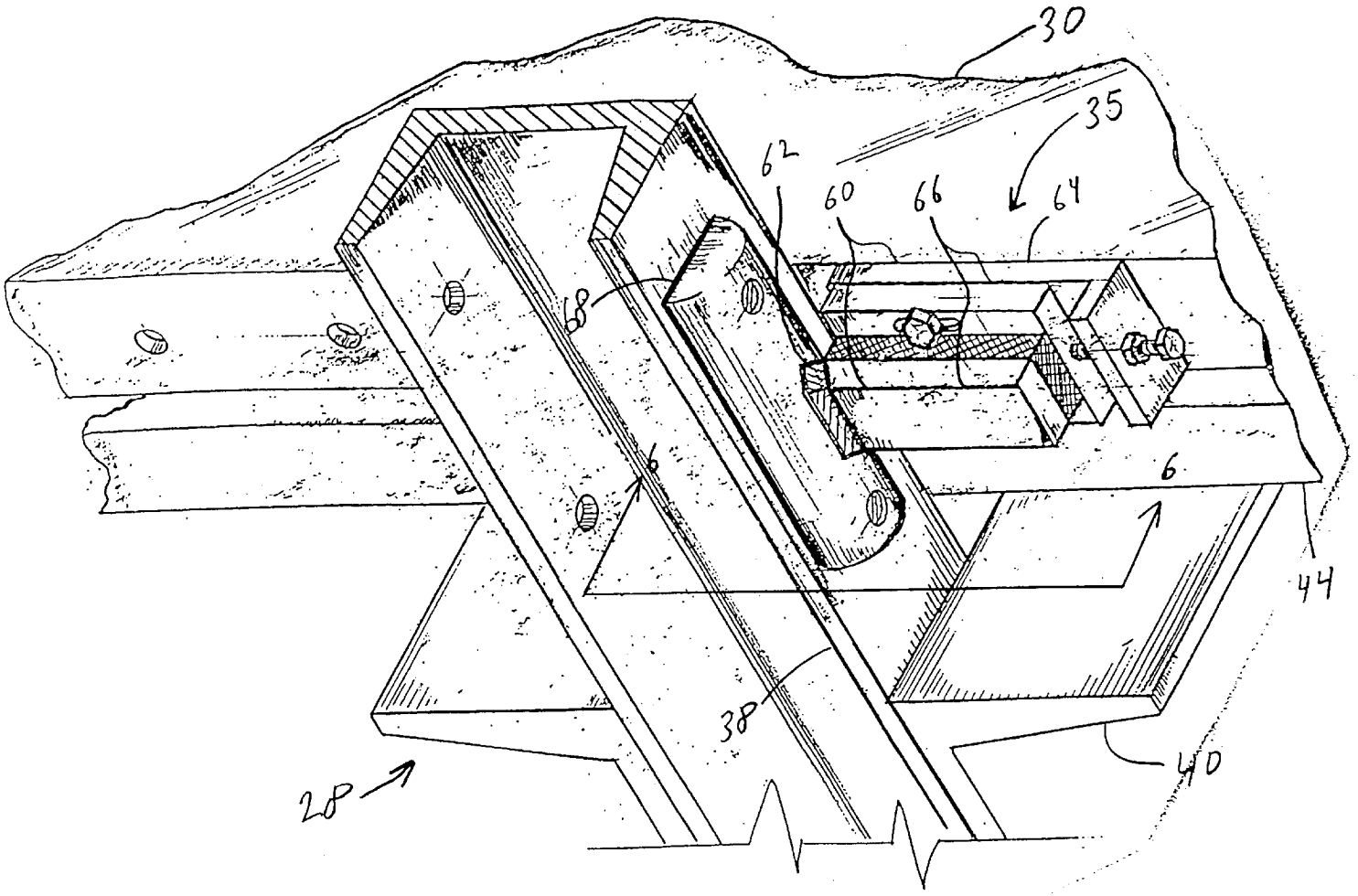
FIG. 5 is an enlargement of section A of FIG. 4 showing the platform stabilization couplers.

Referring to FIGS. 5, an enlargement of section A of FIG. 4 shows the platform stabilization coupler 35 in greater detail. The vibration member 60 includes an L shaped base plate 64 and a sound isolation member 66. The sound isolation member 66 is mounted to the base plate 64, which is in turn bolted against the platform 30. The linear bearing 62 is composed essentially of a high density, self lubricating, low friction polymer pad, e.g., UHMW (Ultra High Molecular Weight) polyethelene. The bearing 62 is bolted to an angled top surface of the sound isolation member 66 and is in moveable contact with an arcuate surface of metallic half round section 68, which is in turn bolted to the lower portion of stiles 38. Though this embodiment describes the linear bearing as a polymer pad, it will be clear to one skilled in the art that other shapes and types of linear bearings may also be used, e.g., a half-round section of polymer or linear ball bearing. Additionally, though this embodiment describes the vibration member 60 as being bolted to the platform 30, it will be clear that the vibration member 60 may be bolted to the elevator car frame 28 and the linear bearing 62 may be disposed against the platform 30.

Figure 6:
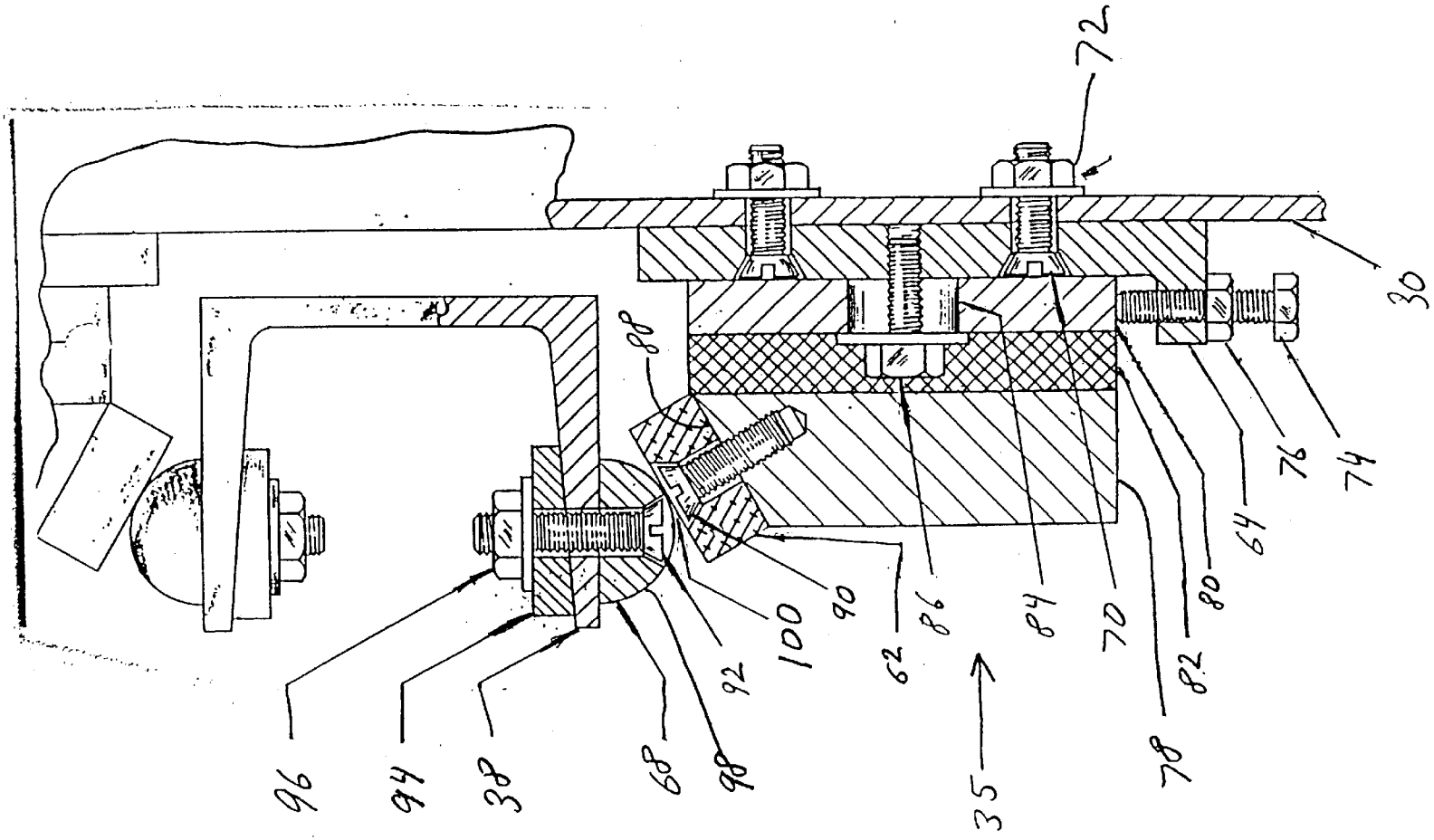
FIG. 6 is a cross-sectional view of the platform stabilization coupler taken along the line 6—6 of FIG. 5.

Referring to FIG. 6, a cross-sectional view of the platform stabilization coupler 35 taken along the line 6—6 in FIG. 5 is shown. The L shaped base plate 64 is rigidly bolted to the platform 30 with flat head screws 70 and flanged nuts 72. Jack screw 74 is threaded through the outwardly extending leg portion of base plate 64 and secured in place with jam nut 76. The jack screw 74 acts as a fine adjustment device biasing the linear bearing 62 against half round section 68 to provide substantially zero lash between the platform 30 and the elevator car frame 28. With a plurality of four platform stabilization couplers 35 mounted on either side of the two stiles 38, the jackscrews 74 are adjusted to substantially hold the lateral movement of the platform 30 relative to the elevator car frame .28 within predetermined limits.

The sound isolation member 66 includes a first top plate 78 and second bottom plate 80 with an elastomeric pad 82 disposed therebetween. The elastomeric pad 82 provides sound isolation while vibrations are transmitted through from the elevator car frame 28 to the platform 30. The bottom plate 80 has a pair of slotted through holes 84 located on either side of the elastomeric pad 82 that are sized to receive flanged head screws 86. The slotted through holes 84 provide coarse adjustment of the sound isolation member 66 before fine adjustments are made with the jack screw 74. The top plate 78 has an angled surface 88, upon which the linear bearing 62 is bolted with flat head screw 90.

The half round section 68 is bolted to the stile 38 with flat head screw 92, beveled washer 94 and flanged nut 96. During assembly, jack screw 74 is used to adjust for zero clearance between half round section 68 and the linear bearing 62. Arcuate surface 98 of the half round section 68 insures a single line of contact 100 along the entire width of linear bearing 62, thus keeping surface area and frictional losses to a minimum during vertical movement of the platform 30 relative to the elevator car frame 28.

Figure 1:
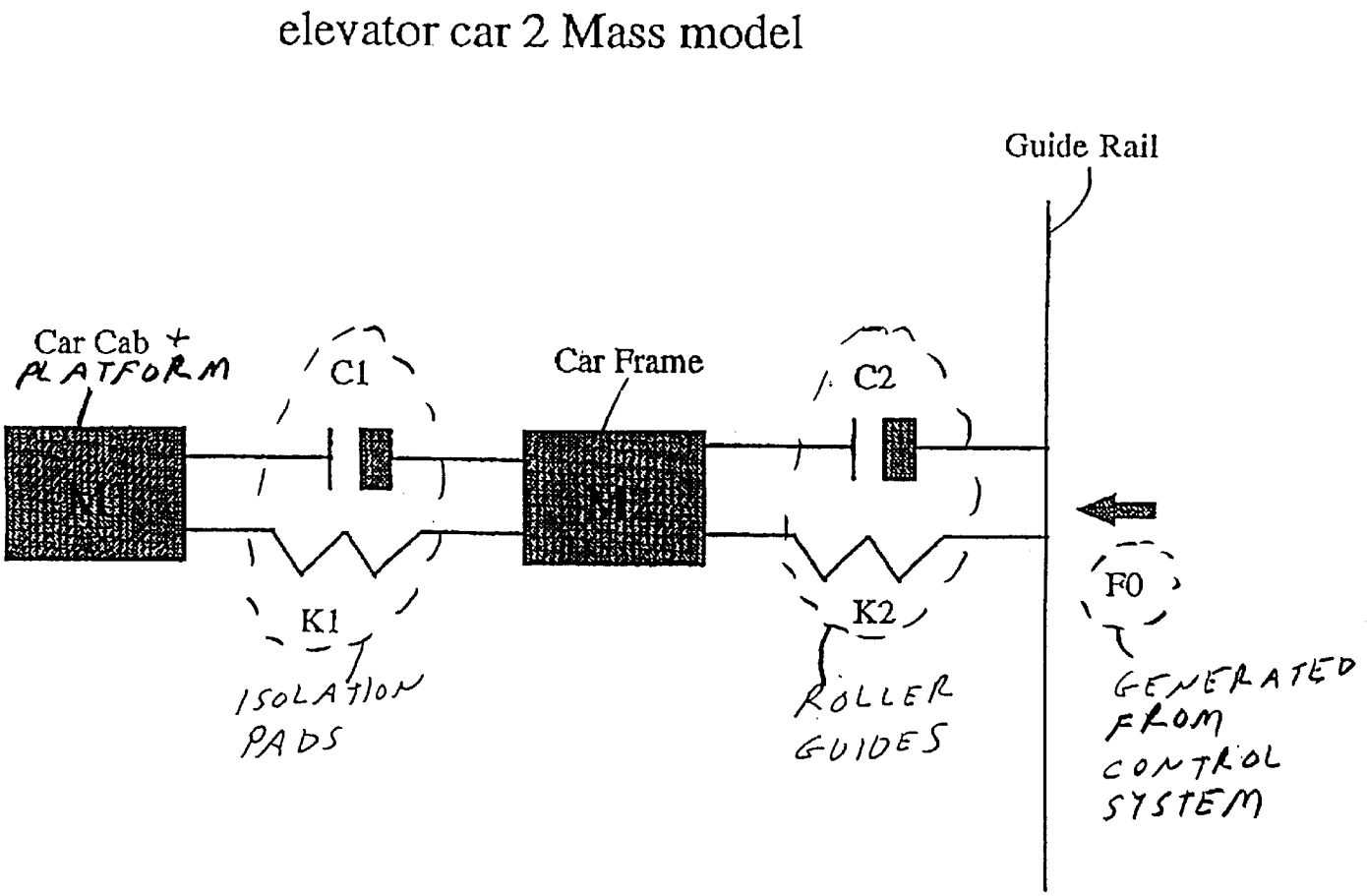
FIGURE 1 (PRIOR ART)
FIG. 1 is a prior art elevator car two mass block diagram.
Figure 7:
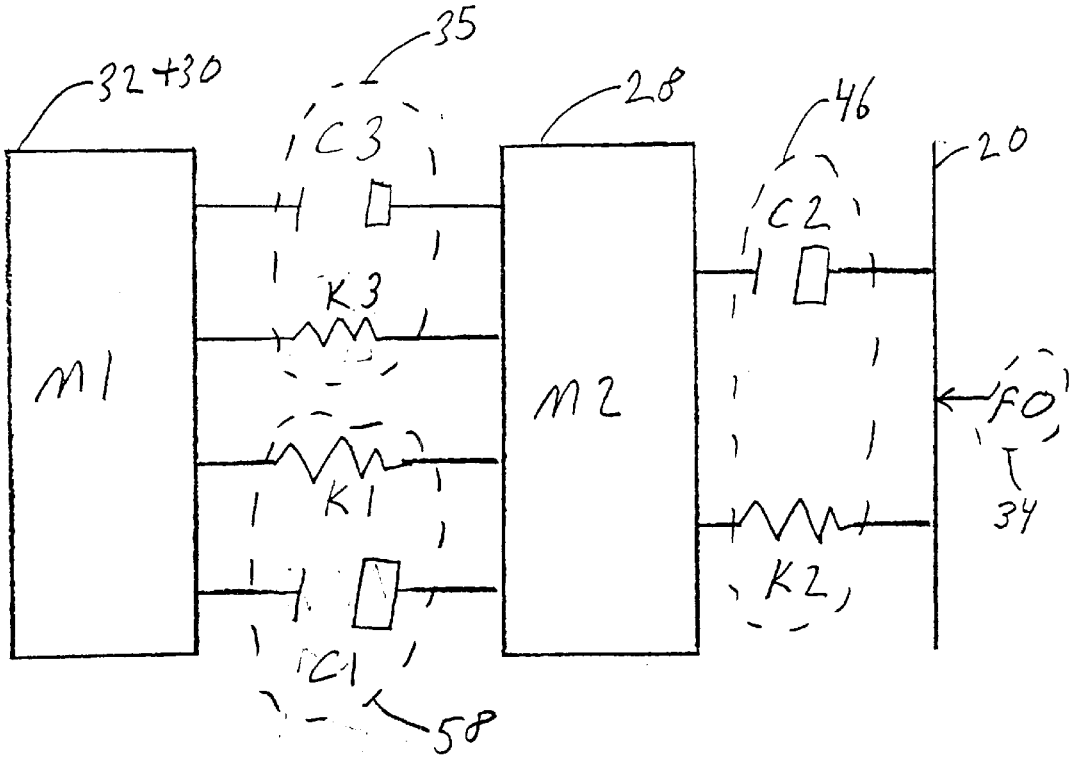
FIG. 7 is an elevator car two mass block diagram in accordance with the present invention.

Referring to FIG. 7, the elevator car 14 two mass block diagram having guidance system 34 is shown. In contrast to the prior art system of FIG. 1, the predetermined and consistent damping coefficient C3 and spring contact K3 of the stabilization couplers 35 are coupled in the feedback path in parallel with the inherently invisible damping coefficient C1 and spring constant K1 of the isolation pads 58. However, C3 and K3 are substantially greater than C1 and K1 respectively. That is, the stabilization couplers 35 effectively bypass the isolation pads 58 in the vibration feedback path.

Figure 8:
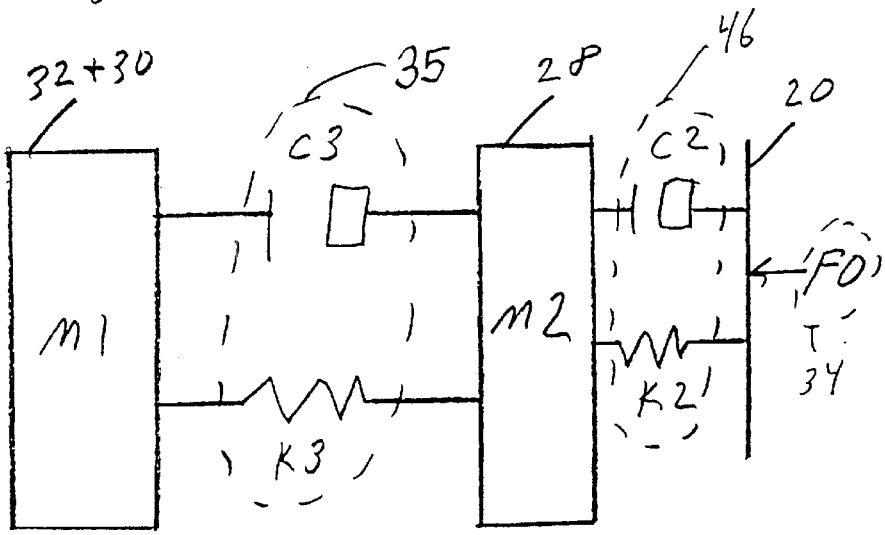
FIG. 8 is an effective two mass block diagram of FIG. 7.

Referring to FIG. 8, the effective two mass block diagram of FIG. 7 is shown. Since C1 and K1 are insignificant compared to C3 and K3 respectively, the plateau resonance is essentially determined by the effective mass M1 of the cab 32 and platform 30 and the spring rate K3 and damping coefficient C3 of the stabilization couplers 35 only. Therefore, the block diagram can be drawn without the spring constant K1 and damping coefficient C1 of the isolation pads 58 and still accurately model the response of the elevator cab 32/platform 30 mass M1 to FO generated from control system 34.

The platform stabilization couplers 35 do not have to perform the additional functions of the isolation pads 58, i.e. primary sound isolation and load sensing. Therefore, variations in the manufacturing process of the couplers 35 can be eliminated to provide predetermined and substantially constant spring constants and damping coefficients. Because sound isolation is only a secondary function of the couplers 35, the elastomeric pad 82 of the sound isolation member 66 can be selected from a heavier durometer material than that of the isolation pads 58. This greatly increases the tolerance and consistency of the spring constant and damping coefficient.

Additionally, it will be clear to one skilled in the art that other materials other than elastomers may be used for sound isolation, e.g., wood pads. Also, in some cases the platform stabilization couplers 35 may not require sound isolation at all, since that is the primary function of the isolation pads 58. Rather the vibration member 60 may be constructed of a single block.

Figure 9:
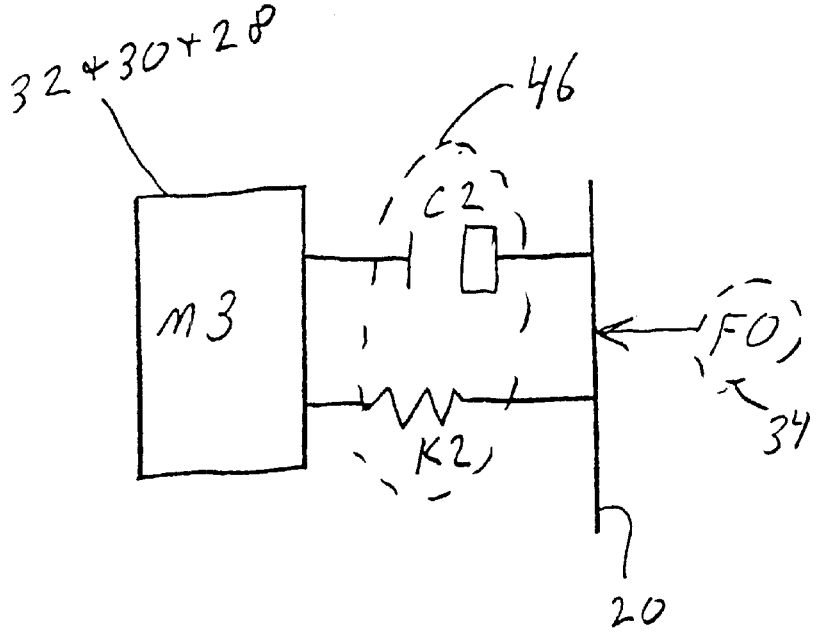
FIG. 9 is an alternative embodiment single mass block in accordance with the present invention.

Referring to FIG. 9, an alternate embodiment of the mass block diagram is shown wherein the platform stabilization couplers 35 are adjusted such that the cab 32/platform 30 mass M1 and the mass M2 of the car frame 28 effectively move as one single mass M3. During operation, the platform stabilization couplers 35 hold the lateral movement of the platform 30 to predetermined limits. Jack screws 74 (best shown in FIG. 6) can be adjusted to substantially reduce the predetermined limits to essentially zero, i.e., zero lash between platform 30 and car frame 28. Under this embodiment, the system can be modeled as a single mass M3 block diagram since the cab 32/platform 30 mass M1 and the car frame 28 mass M2 move as one mass M3. This greatly reduces the complexity of the software required for control system 35 to control platform 30 vibrations.

The platform stabilization couplers 35 may additionally be used as a kit, i.e., spare part, to retrofit existing prior art elevator systems. When the platform stabilization couplers 35 are adjusted for zero lash, they can improve ride quality even without an active guidance system 35 on prior art systems. Additionally, they can also significantly enhance the performance of prior art guidance systems when installed.

While the preferred embodiments have been herein described, it is understood that various modification to and deviation from the described embodiments may be made without departing from the scope of the presently claimed invention.

What is claimed is:

1. A control system for controlling acceleration of an elevator platform disposed on an elevator car frame, the system comprising:

an acceleration sensor disposed in fixed relation to either of the elevator car frame and the platform, the acceleration sensor generating an acceleration signal indicative of acceleration of the platform;

a controller responsive to the acceleration signal, wherein the controller generates an acceleration force opposed to the acceleration of the platform; and a platform stabilization coupler for transmitting the opposing acceleration force to the platform, the coupler including, a vibration member having a first surface disposed in fixed relation to either one of the elevator car frame and the platform, and a linear bearing disposed in fixed relation to a second surface of the vibration member, the bearing disposed in moveable relation with the other of the elevator car frame and the platform to allow substantially vertical movement of the platform relative to the elevator car frame, wherein the vibration member and linear bearing provide a transmission path for the opposing acceleration force from the elevator car frame to the platform.

2. The acceleration control system of claim 1 wherein the platform stabilization coupler further comprises a substantially constant damping coefficient and spring rate.

3. The acceleration control system of claim 1 wherein the platform stabilization coupler further comprises a predetermined damping coefficient and spring rate.

4. The acceleration control system of claim 1 wherein the platform stabilization coupler further comprises a plurality of platform stabilization couplers disposed between the platform and the elevator car frame to substantially hold the lateral movement of the platform relative to the elevator car frame within predetermined limits.

5. The acceleration control system of claim 1 wherein the vibration member further comprises a sound isolation device, the device including a first and second plate having an elastomeric pad disposed therebetween.

6. The acceleration control system of claim 5 wherein the vibration member further comprises a base plate upon which the sound isolation device is mounted, the base plate including an adjustment device for adjusting pressure against the sound isolation device to provide substantially zero lash between the platform and the elevator car frame.

7. The acceleration control system of claim 1 wherein the linear bearing further comprises a hi-density, low friction polymer pad.

8. The acceleration control system of claim 1 further comprising a half round section rigidly disposed on the elevator car frame, wherein an arcuate surface of the half round section is movably disposed against a surface of the linear bearing in substantially line on line contact.

9. The acceleration control system of claim 1 further comprising an Active Roller Guide control system.

10. An elevator system comprising:

An elevator car for carrying passengers, the elevator car including an elevator car frame, an elevator platform disposed on the elevator car frame upon which the passengers stand and an elevator cab disposed on the platform; and a control system for controlling acceleration of the elevator platform, the system including, an acceleration sensor disposed in fixed relation to the platform, the acceleration sensor generating an acceleration signal indicative of acceleration of the platform, a controller responsive to the acceleration signal, wherein the controller generates an acceleration force opposed to the acceleration of the platform, and a platform stabilization coupler for transmitting the opposing acceleration force to the platform, the coupler including, a vibration member having a first surface disposed in fixed relation to either one of the elevator car frame and the platform, and a linear bearing disposed in fixed relation to a second surface of the vibration member, the bearing disposed in moveable relation with the other of the elevator car frame and the platform to allow substantially vertical movement of the platform relative to the elevator car frame, wherein the vibration member and linear bearing provide a transmission path for the opposing acceleration force from the elevator car frame to the platform.

11. The elevator system of claim 10 wherein the platform stabilization coupler further comprises a substantially constant damping coefficient and spring rate.

12. The elevator system of claim 10 wherein the platform stabilization coupler further comprises a predetermined damping coefficient and spring rate.

13. The elevator system of claim 10 wherein the platform stabilization coupler further comprises a plurality of platform stabilization couplers disposed between the platform and the elevator car frame to substantially hold the lateral movement of the platform relative to the elevator car frame within predetermined limits.

14. The elevator system of claim 10 wherein the vibration member further comprises a sound isolation device, the device including a first and second plate having an elastomeric pad disposed therebetween.

15. The elevator system of claim 14 wherein the vibration member further comprises a base plate upon which the sound isolation device is mounted, the base plate including an adjustment device for adjusting pressure against the sound isolation device to provide substantially zero lash between the platform and the elevator car frame.

16. The elevator system of claim 10 further comprising an Active Roller Guide control system.

17. A control system for controlling lateral acceleration of an elevator platform disposed on an elevator car frame, the system comprising:

an acceleration sensor disposed in fixed relation to either of the elevator car frame and the platform, the acceleration sensor generating an acceleration signal indicative of lateral acceleration of the platform;

a controller responsive to the acceleration signal, wherein the controller generates a lateral acceleration force opposed to the lateral acceleration of the platform; and a platform stabilization coupler for transmitting the opposing lateral acceleration force to the platform, the coupler including, a linear bearing disposed between the elevator car frame and the platform to allow substantially vertical movement of the platform relative to the elevator frame, thereby providing a direct transmission path for the opposing lateral acceleration forces from the elevator car frame to the platform.

18. The acceleration control system of claim 17 wherein the platform stabilization coupler further comprises a substantially constant damping coefficient and spring rate.

19. The acceleration control system of claim 17 wherein the platform stabilization coupler further comprises a predetermined damping coefficient and spring rate.

20. The acceleration control system of claim 17 wherein the platform stabilization coupler further comprises a plurality of platform stabilization couplers disposed between the platform and the elevator car frame to substantially hold the lateral movement of the platform relative to the elevator car frame within predetermined limits.

21. The acceleration control system of claim 17 wherein the vibration member further comprises a sound isolation device, the device including a first and second plate having an elastomeric pad disposed therebetween.

22. The acceleration control system of claim 21 wherein the vibration member further comprises a base plate upon which the sound isolation device is mounted, the base plate including an adjustment device for adjusting pressure against the sound isolation device to provide substantially zero lash between the platform and the elevator car frame.

23. The acceleration control system of claim 17 wherein the linear bearing further comprises a hi-density, low friction polymer pad.

24. The acceleration control system of claim 17 further comprising a half round section rigidly disposed on the elevator car frame, wherein an arcuate surface of the half round section is movably disposed against a surface of the linear bearing in substantially line on line contact.

25. The acceleration control system of claim 17 further comprising an Active Roller Guide control system.

26. An elevator system comprising:

An elevator car for carrying passengers, the elevator car including an elevator car frame, an elevator platform disposed on the elevator car frame upon which the passengers stand and an elevator cab disposed on the platform; and a control system for controlling acceleration of the elevator platform, the system including, an acceleration sensor disposed in fixed relation to the platform, the acceleration sensor generating an acceleration signal indicative of acceleration of the platform, a controller responsive to the acceleration signal, wherein the controller generates an acceleration force opposed to the acceleration of the platform, and a platform stabilization coupler for transmitting the opposing acceleration force to the platform, the coupler including, a vibration member having a first surface disposed in fixed relation to either one of the elevator car frame and the platform, and a linear bearing disposed in fixed relation to a second surface of the vibration member, the bearing disposed in moveable relation with the other of the elevator car frame and the platform to allow substantially vertical movement of the platform relative to the elevator car frame, wherein the vibration member and linear bearing provide a transmission path for the opposing acceleration force from the elevator car frame to the platform.

27. The elevator system of claim 2 wherein the platform stabilization coupler further comprises a substantially constant damping coefficient and spring rate.

28. The elevator system of claim 2 wherein the platform stabilization coupler further comprises a predetermined damping coefficient and spring rate.

29. The elevator system of claim 2 wherein the platform stabilization coupler further comprises a plurality of platform stabilization couplers disposed between the platform and the elevator car frame to substantially hold the lateral movement of the platform relative to the elevator car frame within predetermined limits.

30. The elevator system of claim 2 wherein the vibration member further comprises a sound isolation device, the device including a first and second plate having an elastomeric pad disposed therebetween.

31. The elevator system of claim 6 wherein the vibration member further comprises a base plate upon which the sound isolation device is mounted, the base plate including an adjustment device for adjusting pressure against the sound isolation device to provide substantially zero lash between the platform and the elevator car frame.

32. The elevator system of claim 2 further comprising an Active Roller Guide control system.

* * * * *